US005963986A

United States Patent [19]

Deppen

[11] Patent Number: 5,963,986

[45] Date of Patent: Oct. 12, 1999

[54] DISPOSABLE CAPE

[76] Inventor: Juanita M. Deppen, 3996 North Parkside Dr., Hoffman Estates, Ill. 60195

[21] Appl. No.: 09/140,044

[22] Filed: Aug. 26, 1998

Related U.S. Application Data

[63] Continuation-in-part of application No. 29/087,124, Apr. 27, 1998, abandoned.

[51] Int. Cl.[6] ..... A41B 13/10

[52] U.S. Cl. ..... 2/50; 2/49.1

[58] Field of Search ..... 2/48, 49.1, 49.2, 2/49.3, 49.4, 49.5, 51, 52, 60; 383/8, 9, 37

[56] References Cited

U.S. PATENT DOCUMENTS

| | | | |
|---|---|---|---|
| H1738 | 7/1998 | Reinhart, Jr. | 2/49.1 |
| D. 357,568 | 4/1995 | Schottland | D2/861 |
| 3,221,341 | 12/1965 | Hummel | 2/49 |
| 3,332,547 | 7/1967 | Rowe et al. | 206/56 |
| 3,416,157 | 12/1968 | Marder et al. | 2/49 |
| 3,916,447 | 11/1975 | Thompson | 2/46 |
| 4,288,877 | 9/1981 | Klepfer | 2/48 |
| 4,306,316 | 12/1981 | Klepfer | 2/48 |
| 4,330,888 | 5/1982 | Klepfer | 2/48 |
| 4,622,698 | 11/1986 | Heyman et al. | 2/49 R |
| 4,676,378 | 6/1987 | Baxley et al. | 383/9 |
| 4,884,299 | 12/1989 | Rose | 2/49 R |
| 5,074,674 | 12/1991 | Kuklies et al. | 383/8 |
| 5,207,328 | 5/1993 | Bose et al. | 383/8 |
| 5,465,845 | 11/1995 | Norby et al. | 383/8 |
| 5,465,846 | 11/1995 | Blyth et al. | 383/9 |
| 5,493,809 | 2/1996 | Weder et al. | 383/9 |

*Primary Examiner*—John J. Calvert
*Assistant Examiner*—Katherine Moran
*Attorney, Agent, or Firm*—Thomas R. Vigil

[57] ABSTRACT

The disposable cape comprises: a generally rectangular sheet of plastic material having an upper portion thereof with a U-shaped cutout defining therebetween two straps or handles with each strap or handle having a hole therethrough, said straps or handles being adapted to be received around a person's neck and under the chin and held in place by the finger of a person wearing the cape which is inserted through the two holes when the two holes are brought into alignment with each other.

The sheet of plastic material from which a disposable neck cape can be pulled away is generally rectangular and has an upper small body portion, including an upper margin having at least one hole therein for mounting the sheet on at least one support rod and a perforated line extends first laterally from one side edge of the sheet into the sheet generally parallel to the upper margin and spaced below an upper edge of the sheet to a generally U-shaped perforated line which extends downwardly through a bight portion of the line and then upwardly to a second line of perforations located beneath the upper edge of the sheet and then extends to an opposite side edge of the sheet.

11 Claims, 2 Drawing Sheets

DISPOSABLE CAPE

CROSS-REFERENCE TO RELATED APPLICATIONS

This application is a continuation-in part of U.S. Design Application Ser. No. 29/087,124, filed Apr. 27, 1998, now abandoned.

BACKGROUND OF THE INVENTION

1. Field of the Invention

The present invention relates to a disposable cape, particularly for use in salons, such as beauty salons and for being draped around the back of the neck and back of a customer receiving a shampoo. More particularly, the disposable neck cape is used for protecting clothing worn on the back of a customer when the customer is receiving a shampoo.

2. Description of the Prior Art

Heretofore a number of disposable bibs, having some similarity to a disposable cape have been proposed.

Examples of the previously proposed bibs and methods for making same, including bibs in a strip adapted to be pulled away from the strip sequentially, are disclosed in the following U.S. patents:

| U.S. Pat. No. | Patentee |
|---|---|
| Des. 357,568 | Schottland |
| H 1738 | Reinhart, Jr. |
| 3,221,341 | Hummel |
| 3,332,547 | Rowe et al. |
| 3,416,157 | Marder, et al. |
| 3,916,447 | Thompson |
| 4,288,877 | Klepfer |
| 4,306,316 | Klepfer |
| 4,330,888 | Klepfer |
| 4,622,698 | Heyman et al. |
| 4,884,299 | Rose |

The Hummel U.S. Pat. No. 3,332,547 discloses a disposable bib which is detached from a flexible plastic strip of such bibs.

The Heyman et al. U.S. Pat. No. 4,622,698 discloses a continuous strip of absorbent non-woven paper like material with perforations therein for separating sequentially from the strip disposable bibs.

The Rose U.S. Pat. No. 4,884,299 discloses disposable bibs which can be pulled from a roll or which can be stored in a bag or pulled out of a box, similar to a box of facial tissues.

As will be described hereinafter, the disposable capes of the present invention are not pulled sequentially from a continuous strip but rather are suspended from a rack or holder where a disposable cape portion is pulled away from an upper small body portion suspended from a rack and separated along a perforated line between the disposable cape portion and the upper small body portion of each sheet of material.

SUMMARY OF THE INVENTION

According to the present invention there is provided a disposable cape comprising a single ply, generally rectangular sheet of plastic material having a bottom edge and opposite side edges and an upper portion thereof with a U-shaped cutout defining: (a) therebetween, two straps each having an inner side edge and an outer side edge which is defined by one of the opposite side edges of the sheet of material, each strap having a hole therethrough located approximately midway between the inner and outer side edges, the straps being constructed and arranged to be received around a person's neck and under the chin and held in place by a finger of a person wearing the cape, the finger being inserted through the two holes when the two holes are brought into alignment with each other and (b) therebelow, a concave upper edge of a lower, cape forming body portion, and the single ply sheet of material not being engaged with adjacent sheets along side and bottom edges of each sheet of material.

Further according to the present invention there is provided a single ply sheet of plastic material from which a disposable neck cape can be pulled away, such sheet being generally rectangular and having an upper small body portion, including an upper margin having at least one hole therein for mounting the sheet on at least one support rod, the upper small body portion being delineated from a lower, disposable, cape forming portion by a line of perforations including a first, straight perforated line which extends laterally from one side edge of the sheet into the sheet generally parallel to the upper margin and spaced below an upper edge of the sheet to a generally U-shaped perforated line which extends downwardly, first along a leg portion of the U-shaped line, along a bight portion of the U-shaped line and then upwardly along a second leg portion of the U-shaped line to a second, straight perforated line which extends laterally from the second leg portion of the U-shaped line to the opposite side edge of the sheet and generally parallel to the upper margin and spaced below the upper edge of the sheet.

DESCRIPTION OF THE PREFERRED EMBODIMENT(S)

Figure 1:
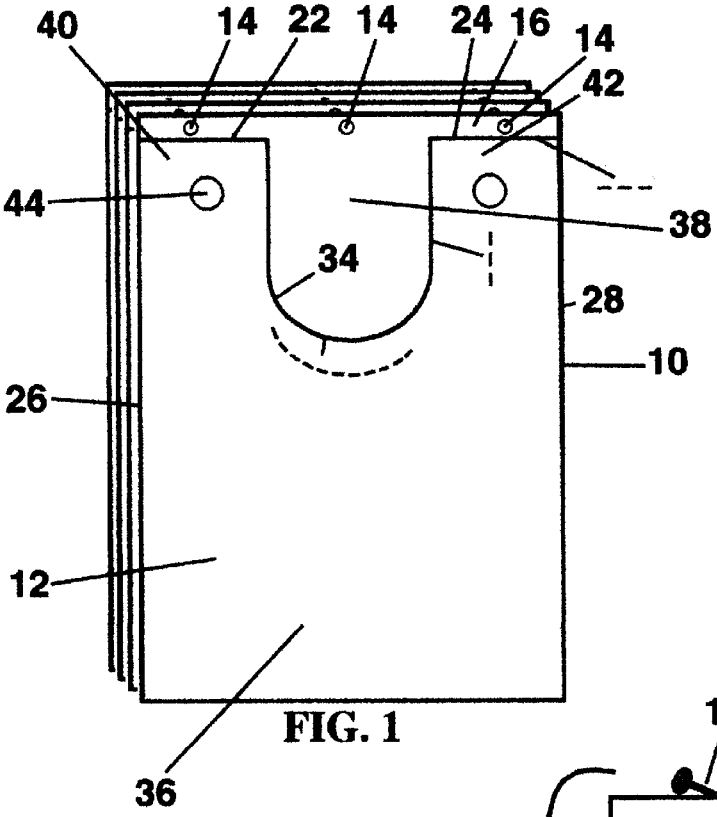
FIG. 1 is a perspective view of a portion of a stack of plastic sheets constructed according to the teachings of the present invention, each having a perforated line for separating a lower disposable cape portion from an upper small body portion of the sheet of material.

Referring now to the drawings in greater detail, there is illustrated in FIG. 1 a portion of a stack 10 of sheets 12 of material which can be made of plastic and which can be opaque, translucent or transparent.

As shown in FIG. 1, each sheet 12 includes one, two or three holes 14 in an upper margin 16 thereof along the top of the sheet 12, which is generally rectangular in shape. The holes 14 are provided for supporting the stack 10 of sheets 12 on one to three rods, such as the two support or holder rods 18 and 20 shown in FIG. 2.

In FIG. 1, three holes 14 are shown for supporting the stack on the rods (not shown).

Then, a perforated line 22 or 24 extends laterally from each side edge 26 and 28 of the sheet 12 just below the upper margin 16 of the sheet 12 and generally horizontally of each sheet 12 as shown. Typically, these perforated lines 22 and 24 extend between one and six inches, with one preferred length being five inches, to form straps or handles 30 and 32 which are one to six inches wide.

Then, at a point one to six inches from each side edge 26 and 28 of the sheet 12 there is provided in the sheet 12, a generally U-shaped perforation line 34 which extends downwardly from each of the generally horizontal perforated lines 22 and 24. The perforated lines 22, 24 and 34 enable one to pull a lower disposable cape forming portion 36 downwardly away from an upper small body portion 38 which is left on the support rods, such as the two supporting rods 18 and 20, shown in FIG. 2.

Figure 2:
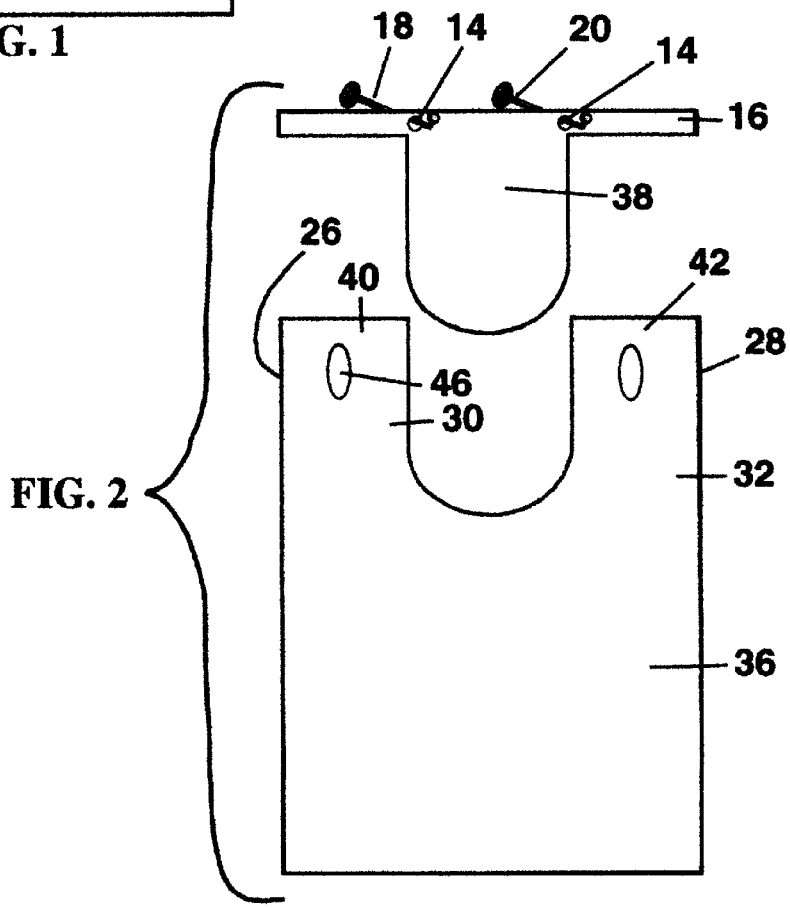
FIG. 2 is an exploded front perspective view of a sheet of material similar to, but modified slightly from, the sheet shown in FIG. 1 and shows a disposable cape portion separated from the suspended small upper body portion.

Near an upper end 40 or 42 of each strap or handle 30 or 32 of the disposable cape forming portion 36 there is formed a hole 44 (FIG. 1) or 46 (FIG. 2). The hole 44 shown in FIG. 1 is a circular hole 44 and the hole 46 shown in FIG. 2 is an oval-shaped hole 46. The oval-shaped hole 46 may be preferred for simplifying manufacture of the sheets 12, since they apparently are easier to form with punching machinery.

Different thicknesses of plastic sheet material between 0.05 and 6 mm. can be utilized. A sheet 12 having approximately 2 mm. thickness of polyvinylchloride or polyvinylidene has been found to work satisfactorily.

It will be understood that the stack 10 of sheets 12 of material shown in FIG. 1 are adapted to be supported on the one, two or three support rods that extend out from a wall or from a panel or support board attached to a wall surface or laid on a horizontal surface, such as a table top.

Figure 3:
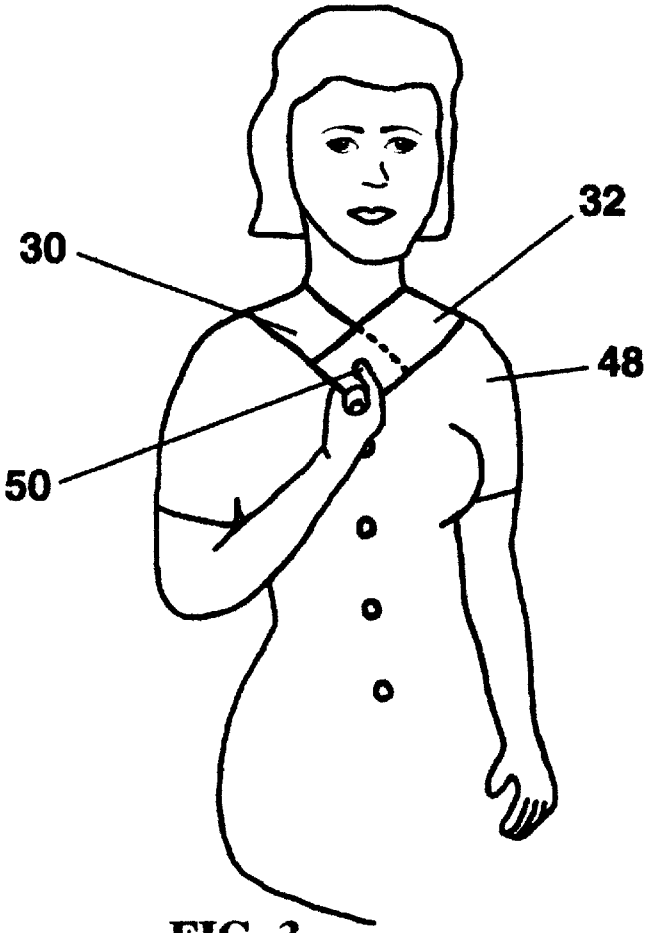
FIG. 3 is a front view of a woman holding two upper straps of the disposable cape portion around her neck.
Figure 4:
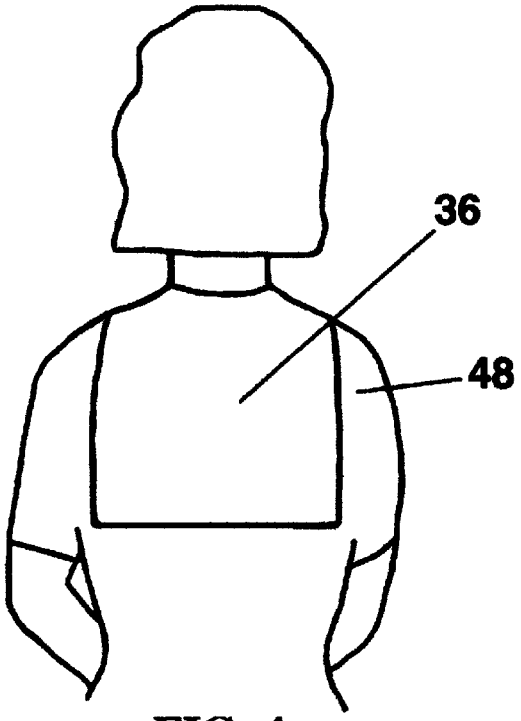
FIG. 4 is a back view of the woman shown in FIG. 3 and shows the disposable cape extending downwardly over the woman's shoulders and back.

Referring now to FIGS. 3–4, it will be understood that the lower disposable cape portion 36 is torn away from the upper smaller body portion 38, as shown in FIG. 2, to provide a disposable neck cape 36 which can be received over a person's back, such as over the back of the woman 48 shown in FIG. 4. The handles or straps 30 and 32 at the top of the disposable neck cape 36 are adapted to be received over the neck and brought together and held by a finger 50 of the woman 48 shown in FIG. 3, who inserts her finger 50 through the aligned holes 44 or 46 after the straps 30 and 32 are crossed, as shown in FIG. 3.

From the foregoing description, it will be apparent that the sheets 12 of plastic material shown in FIG. 1, each containing a lower disposable cape forming portion 36 and an upper small body portion 38 connected by perforated lines 22, 24 and 34 provide a generally rectangular sheet of material which by reason of the three holes 14 shown in FIG. 1 or the two holes 14 shown in FIG. 2, can easily be held on one to three support rods 14 in a beauty salon or any place where disposable capes 36 are desired. Then, whenever it is necessary to provide a disposable cape 36, an operator at a beauty salon, or other establishment, would pull the lower disposable neck cape portion 36 from the upper smaller body portion 38, as shown in FIG. 2, to provide the disposable neck cape 36, for use in the manner shown in FIGS. 3–4.

Then, such a disposable neck cape portion 36 can be held by a finger 50 of one hand of the person wearing same, as shown in FIG. 3.

From the foregoing description, it will be apparent that applicant's special perforated and punched sheets 12 shown in FIG. 1 for being assembled with other like sheets in a stack 10, as shown in FIG. 1, and mounted on one, two or three support rods, such as support rods 14 shown in FIG. 2, provide a magazine or supply of sheets from which can be pulled apart a disposable neck cape as shown in FIG. 2.

The mounting of the stack 10 on one, two or three support rods, such as the two support rods 18 and 20 shown in FIG. 2, enable the stack 10 of sheets 12 to be mounted on a wall adjacent a sink where a salon operator can easily pull a disposable neck cape from the sheet, as shown in FIG. 2, for positioning about a customers' back and neck, as shown in FIG. 4, and the disposable neck cape 36 can be held in place by a finger 50 of the person 48 receiving hair treatment.

Also from the foregoing description it will be apparent that the stack 10 of sheets 12 and the disposable neck cape 36 which can be pulled away from the upper small body portion 38 of a sheet 12, as shown in FIG. 2, provide a number of advantages some of which have been described above and others of which are inherent in the invention. Accordingly, the scope of the invention is only to be limited as necessitated by the accompanying claims.

I claim:

1. A disposable cape comprising a single layer generally rectangular sheet of plastic material having a bottom edge and opposite side edges and an upper portion thereof with a U-shaped cutout defining: (a) therebetween, two straps each having an inner side edge and an outer side edge which is defined by one of said opposite side edges of said sheet of material, each strap having a hole therethrough located approximately midway between said inner and outer side edges, said straps being constructed and arranged to be received around a person's neck and under the chin and held in place by a finger of a person wearing the cape, the finger being inserted through the two holes when the two holes are brought into alignment with each other and (b) therebelow, a concave upper edge of a lower, cape forming body portion.

2. A single layer sheet of plastic material from which a disposable neck cape can be pulled away, such sheet being generally rectangular and having an upper small body portion, including an upper margin having at least one hole therein for mounting the sheet on at least one support rod, said upper small body portion being delineated from a lower, disposable, cape forming portion by a line of perforations including a first, straight perforated line which extends laterally from one side edge of the sheet into the sheet generally parallel to said upper margin and spaced below an upper edge of the sheet to a generally U-shaped perforated line which extends downwardly, first along a leg portion of the U-shaped line, along a bight portion of the U-shaped line and then upwardly along a second leg portion of the U-shaped line to a second, straight perforated line which extends laterally from the second leg portion of the U-shaped line to the opposite side edge of the sheet and generally parallel to said upper margin and spaced below the upper edge of the sheet.

3. The sheet of claim 2 wherein two straps are defined between each side edge of the sheet and the respective, first and second leg portions of the U-shaped perforated line which define side edges of each strap.

4. The sheet of claim 3 wherein the width of the straps is between one inch and six inches.

5. The sheet of claim 4 wherein each strap has a width of approximately five inches.

6. The sheet of claim 3 wherein each strap has a hole therethrough located approximately midway between said side edges of each strap.

7. The sheet of claim 6 wherein said hole is generally circular.

8. The sheet of claim 6 wherein said hole is generally oval-shaped.

9. The sheet of claim 2 wherein said sheet of material has a thickness between approximately 0.5 mm. and 6 mm.

10. The sheet of claim 2 combined with a plurality of similar sheets each having three spaced apart holes in said upper margin of said upper small body portion, all of which are mounted on three support rods for enabling the lower disposable neck cape forming portion to be pulled away from the smaller upper body portion.

11. The sheet of claim 2 combined with a plurality of similar sheets each having two spaced apart holes in said upper margin of said upper small body portion, all of which are mounted on two support rods for enabling the lower disposable neck cape forming portion to be pulled away from the smaller upper body portion.

* * * * *